US007150226B2

(12) United States Patent
Hirt et al.

(10) Patent No.: US 7,150,226 B2
(45) Date of Patent: Dec. 19, 2006

(54) APPARATUS FOR POSITIONING A ROLL IN AN INKING OR DAMPING UNIT OF A ROTARY PRESS

(75) Inventors: Roland Hirt, Friedberg (DE); Johann Königer, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 11 days.

(21) Appl. No.: 11/062,140

(22) Filed: Feb. 18, 2005

(65) Prior Publication Data

US 2005/0188867 A1 Sep. 1, 2005

(30) Foreign Application Priority Data

Feb. 19, 2004 (DE) ..... 10 2004 008 090

(51) Int. Cl.
*B41F 31/00* (2006.01)
*B41F 13/24* (2006.01)

(52) U.S. Cl. ..... 101/352.01; 101/351.1; 101/247

(58) Field of Classification Search ..... 101/352.01, 101/352.05, 351.1, 351.4, 247, 248, 218, 101/DIG. 35
See application file for complete search history.

(56) References Cited

U.S. PATENT DOCUMENTS 5,142,981 A * 9/1992 Dettinger et al. ..... 101/248
5,272,975 A * 12/1993 Dettinger et al. ..... 101/218
5,463,950 A * 11/1995 Cuir et al. ..... 101/329
6,098,542 A * 8/2000 Dufour ..... 101/352.05
6,668,719 B1 * 12/2003 Reder et al. ..... 101/216
6,712,001 B1 * 3/2004 Plewa ..... 101/218
2001/0035104 A1 11/2001 Petersen et al.

FOREIGN PATENT DOCUMENTS

DE 100 08 215 A1 8/2001
EP 0 826 501 A1 3/1998

* cited by examiner

*Primary Examiner*—Daniel J. Colilla
*Assistant Examiner*—Leo T. Hinze
(74) *Attorney, Agent, or Firm*—Leydig, Voit & Mayer, Ltd.

(57) ABSTRACT

An apparatus is provided for positioning a roll in an inking or damping unit of a rotary press with respect to at least one adjacent roll. The axle of the first roll is mounted in at least one bearing arrangement that is movable with respect to a side wall of the printing unit, and means are provided for determining the position and the pressing forces of the first roll against the adjacent roll. The position and pressing force information is fed to a control device, by means of which the position and the pressing pressure of the first roll can be controlled by combined travel and force regulation.

10 Claims, 4 Drawing Sheets

APPARATUS FOR POSITIONING A ROLL IN AN INKING OR DAMPING UNIT OF A ROTARY PRESS

FIELD OF THE INVENTION

The invention relates to a rotary press, and more particularly to an apparatus for positioning a roll in an inking unit or damping unit of a rotary press.

BACKGROUND OF THE INVENTION

In printing presses, in order to ink the printing forms, roll trains are provided, the individual rolls of which are alternately mounted fixedly and adjustably. The pressing pressure with respect to the adjacent fixedly mounted rolls can be regulated by the adjustably mounted rolls, in order to compensate for influences such as temperature, swelling or shrinking of the diameters. Satisfactory inking of the impression cylinder and thus satisfactory print quality on the printed product are ensured by the maintenance of a constant pressing pressure. Arrangements are also known with two rolls which are in contact with one another and which are both mounted adjustably. For example, a damping solution transfer cylinder and a damping solution applicator roll which are each mounted adjustably can be arranged on damping units between a fixed distributor roll and a form cylinder.

EP 826 501 has disclosed an adjusting apparatus of this type which moves the mounting of a roll with a single linear drive and the movement of the mounting is guided by a rigidly predefined control surface. The pressing pressure of the adjustable roll with respect to the first adjacent roll can be adjusted freely by the linear drive, and the pressing pressure with respect to the other adjacent roll is dependent on the alignment of the control surface and on the pressing pressure on the first roll.

It is generally known from machine tool construction to move work pieces or tools in one plane for machining by means of transport devices known as cross slides. Cross slides of this type are constructed from two linear guides, the second guide being arranged at right angles on the slide of the first guide, and the tool or work piece being fastened on the slide of the second guide.

DE 100 08 215 has disclosed a variable format printing unit in which impression cylinders having different diameters can be used. For this purpose, the mountings of the cylinders are arranged on cross slides and can be adjusted with respect to one another in the radial direction, in order to set the correct axial distance in the event of a production change to another diameter. The second linear movement of the cross slide is provided in the axial direction, in order for it to be possible to regulate the lateral register. Furthermore, other functional devices are also arranged on cross slides in this printing unit, such as an inking and/or damping unit, with the result that they can be positioned appropriately with regard to different impression cylinder diameters.

BRIEF SUMMARY OF THE INVENTION

In view of the foregoing, it is an object of the invention to provide a positioning device for rolls that can be used to position a roll against at least one further roll, and the pressing pressure can be set independently of the diameters and angular positions of said rolls.

This object is achieved by the apparatus of the invention. The pressing pressure with respect to the adjacent rolls is advantageously set by the apparatus according to the invention independently of the diameter of the rollers or the angular position of the interacting rolls. The adaptation of the pressing pressure can be determined by the activation of linear guides.

By means of the processing of force measuring signals in the control device and appropriate activation, complicated settings or adjusting work by an operator is no longer necessary. Influences on the setting forces such as temperature, swelling or shrinking of the diameters due to chemical effects, wear and the dynamic behavior during rotational speed increases, are advantageously compensated for automatically.

The combined travel and force regulation according to the invention simplifies the operation of the printing press considerably and increases the print quality. Other features and advantages can be identified from reading the detailed description and claims.

Embodiments of the invention will be explained in greater detail below with reference to the drawings, in which:

DETAILED DESCRIPTION OF EMBODIMENTS OF THE INVENTION

Figure 1:
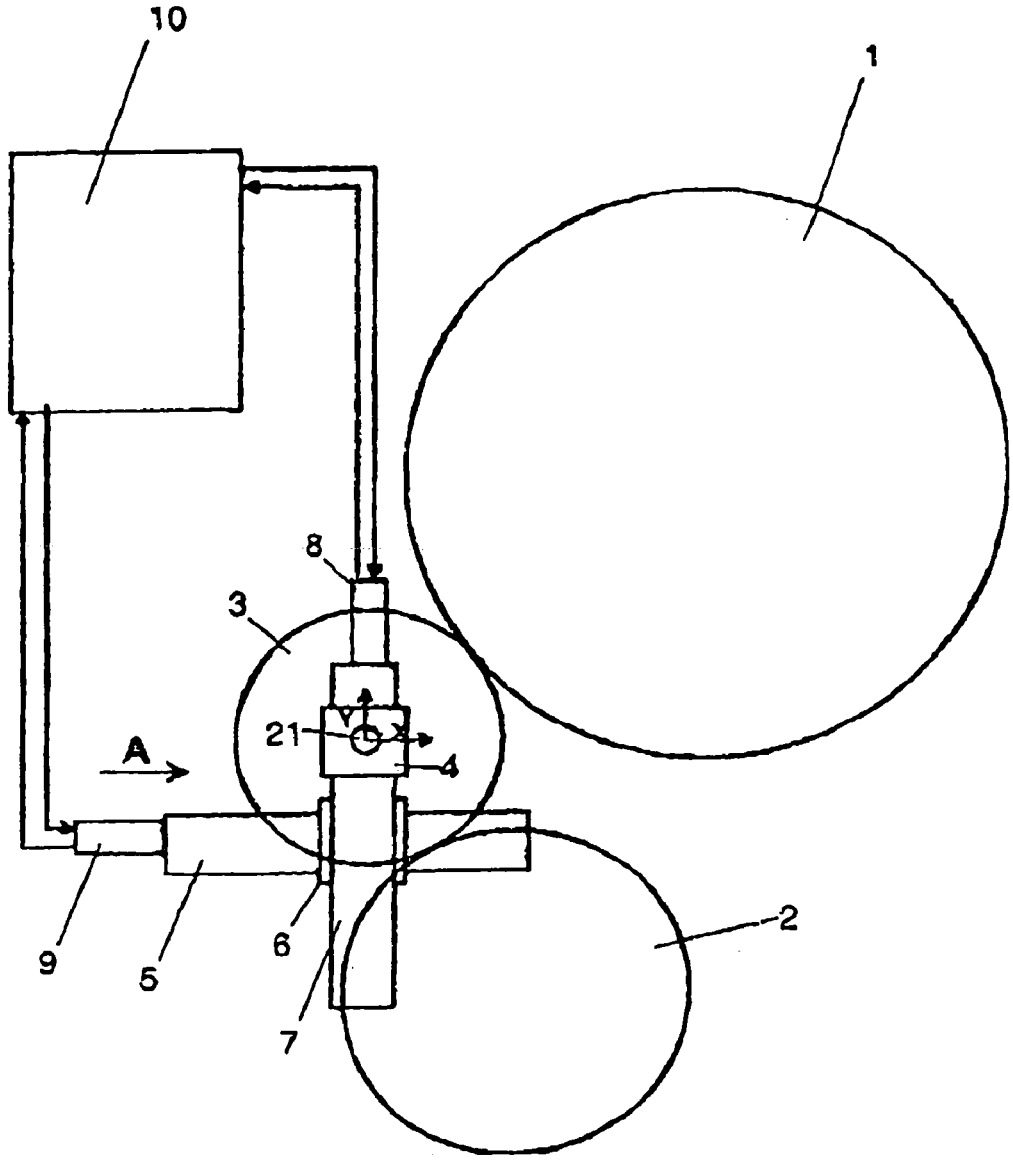
FIG. 1 is a schematic view of an apparatus in one embodiment of the invention, which shows by way of example an ink applicator roll set against a plate cylinder and also against an ink distributor.

FIG. 1 shows a roll 3, which in this example is an ink applicator roll. The roll 3 is set against a plate cylinder 1 and against an ink distributor 2. The axle of the roll 3 is mounted in a bearing arrangement 4 which can be moved in the Y direction in a guide 7. The guide 7 is arranged on a slide 6 which can be moved in the X direction on a further guide 5.

Figure 2:
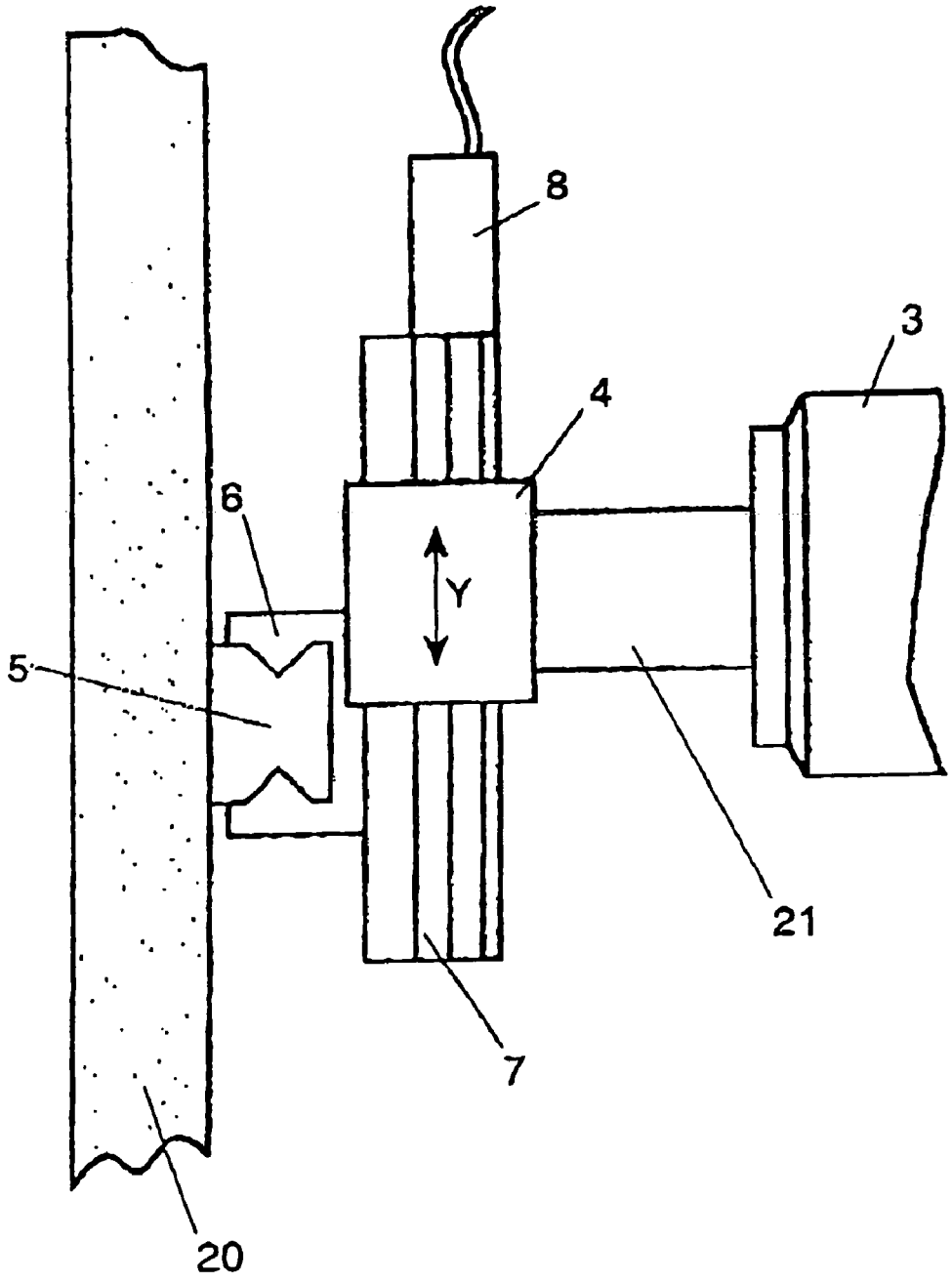
FIG. 2 is a schematic view showing the view A from FIG. 1.

As can be seen from view A shown in FIG. 2, the guide 5 is fastened to a side wall 20 of the printing unit. It is possible to move the slide 6 with the further guide 7 into the plane of the drawing or out of it. The fastening of the axle 21 on the bearing arrangement 4 can also be seen in this view. It is possible to move said bearing arrangement 4 up and down in the guide 7. The roll 3 is rotatably mounted on the axle 21 and can be positioned freely in a plane parallel to the side wall 20 by means of the guides 5, 7 which are arranged in the form of a cross slide. The cross slide are formed by a first linear transport unit, comprising the first guide 5 and the slide 6, and a further linear transport unit, comprising the further guide 7 and the bearing arrangement 4 which is guided therein.

The guides 5, 7 and the slides 6, 4 are preferably standard parts from machine tool construction and do not necessarily have to be arranged at right angles with respect to one another but can assume any angular orientation desired. Drives 8, 9 are provided respectively for the movable slides 4, 6, it being possible to position the latter without play using the former. For this purpose, the drives 8, 9 are actuated by a control device 10, and the drives 8, 9 send back electrical signals of their own to the control device 10, such as the current consumption, angular position, etc. The control device 10 determines the position of the slides 4, 6 from said signals, as well as the forces in the guide directions X, Y. Thus, the drives 8, 9 also serve the functions of position value sensor and force sensors for determining the position of the roll 3 and the pressing forces of the roll 3 on the other rolls 1, 2. However, it is also possible to provide other force and travel measuring systems using different position and force sensors.

In the control device 10, the desired pressure forces of the roll 3 against the two adjacent rolls 1, 2 can be redefined in a variable manner, and the diameters and axial distances of the interacting rolls 1, 2, 3 can be stored. Furthermore, the weight which the roll 3 exerts with its axle 21 and the bearing arrangement 4 can be entered or determined by the apparatus in a thrown-off position.

In order to obtain independent signals from the two bearing points, the roll 3 is preferably not configured with a continuous axle 21 but is equipped on both sides with journals which are decoupled from one another. The control device 10 can determine the forces acting in the X and Y direction and in the directions of the guides 5, 7 from these stipulations and set them by appropriate actuation of the drives 8, 9, with the result that the roll 3 is set against the adjacent rolls 1, 2 with the predefined values. On account of the continuous evaluation of the force measuring signals, the control device 10 continuously compensates for changes in the thrown-on force, for example caused by temperature, swelling or shrinking or the diameters, chemical influences or dynamic behavior during rotational speed increase. As a result, the individually predefined thrown-on forces are maintained automatically. Adjustment curves for the predefined pressure forces can also be stored in the control device 10. Using the adjustment curves, it is possible to change the stipulated values for the pressure forces which are to be set, as a function of the production speed of the rotational speed.

The important concept of the invention lies in the combined roll travel and force regulation, which simplifies the operation of the printing press considerably and increases the print quality. This has a particular advantageous effect during pre-inking of the plate cylinder and cleaning of the inking unit/damping unit rolls, where contact between the rolls is necessary. In the event of an emergency stop, the non-driven rolls can advantageously be kept in contact with the driven rolls and be stopped in a controlled manner.

Figure 3:
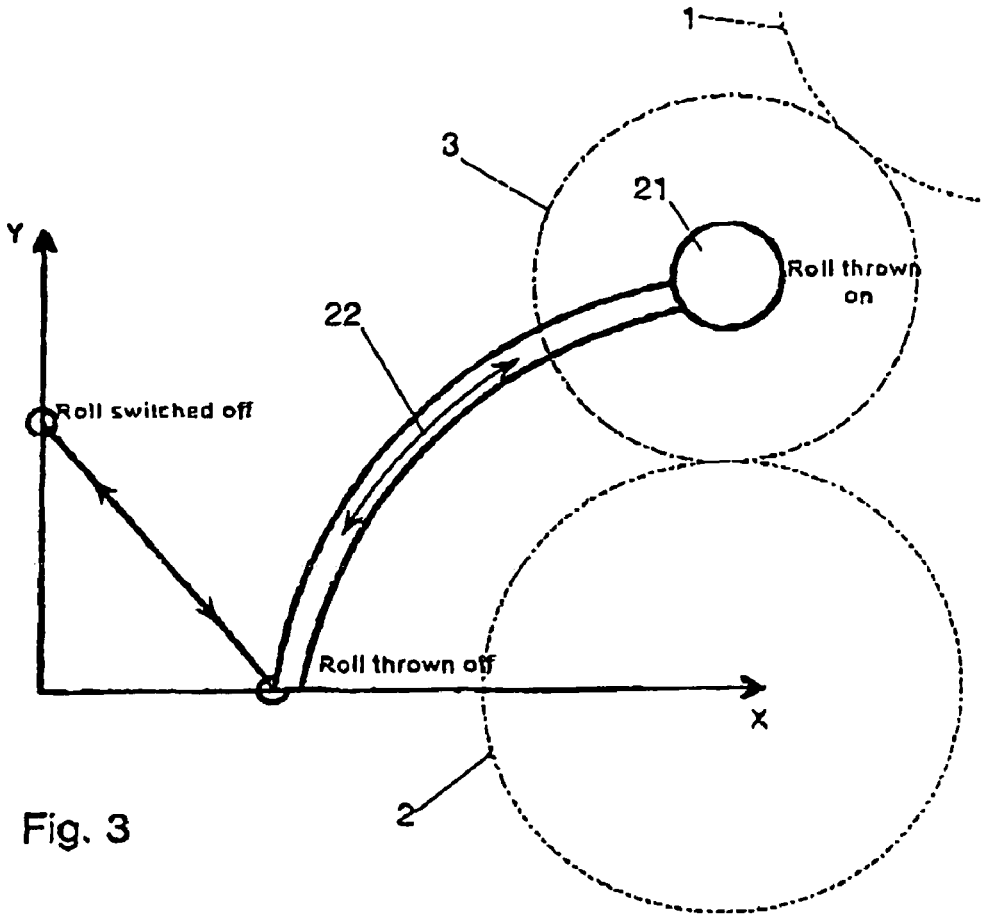
FIG. 3 is a schematic view showing the travel/force regulated movement of the roll axel.

According to FIG. 3, the pressure forces of the roll 3 in the "Roll thrown on" position can be regulated simultaneously with respect to the two other rolls 1, 2 independently of one another. Furthermore, it is also possible using the combined travel and force regulation 30 according to the invention for the roll 3 to be set against one roll, such as the ink distributor roll 2, with a predefined force while it is being thrown off the other roll, such as the plate cylinder 1. For this purpose, the axel 21 of the roll 3 is moved arcuately around the roll 2 by travel regulation and, at the same time, the predefined thrown-on force is maintained by means of force regulation. The roll 3 can also be moved into "Roll switched off" positions in which it is set away from both adjacent rolls 1, 2. For this purpose, any desired positions that can be moved to via pure travel regulation can be predefined in the control device 10.

In addition to the application illustrated by way of example on an ink applicator roll which is arranged between an ink distributor and a plate cylinder, the apparatus according to the invention can also be provided for other rolls of an inking unit and/or damping unit.

Figure 4:
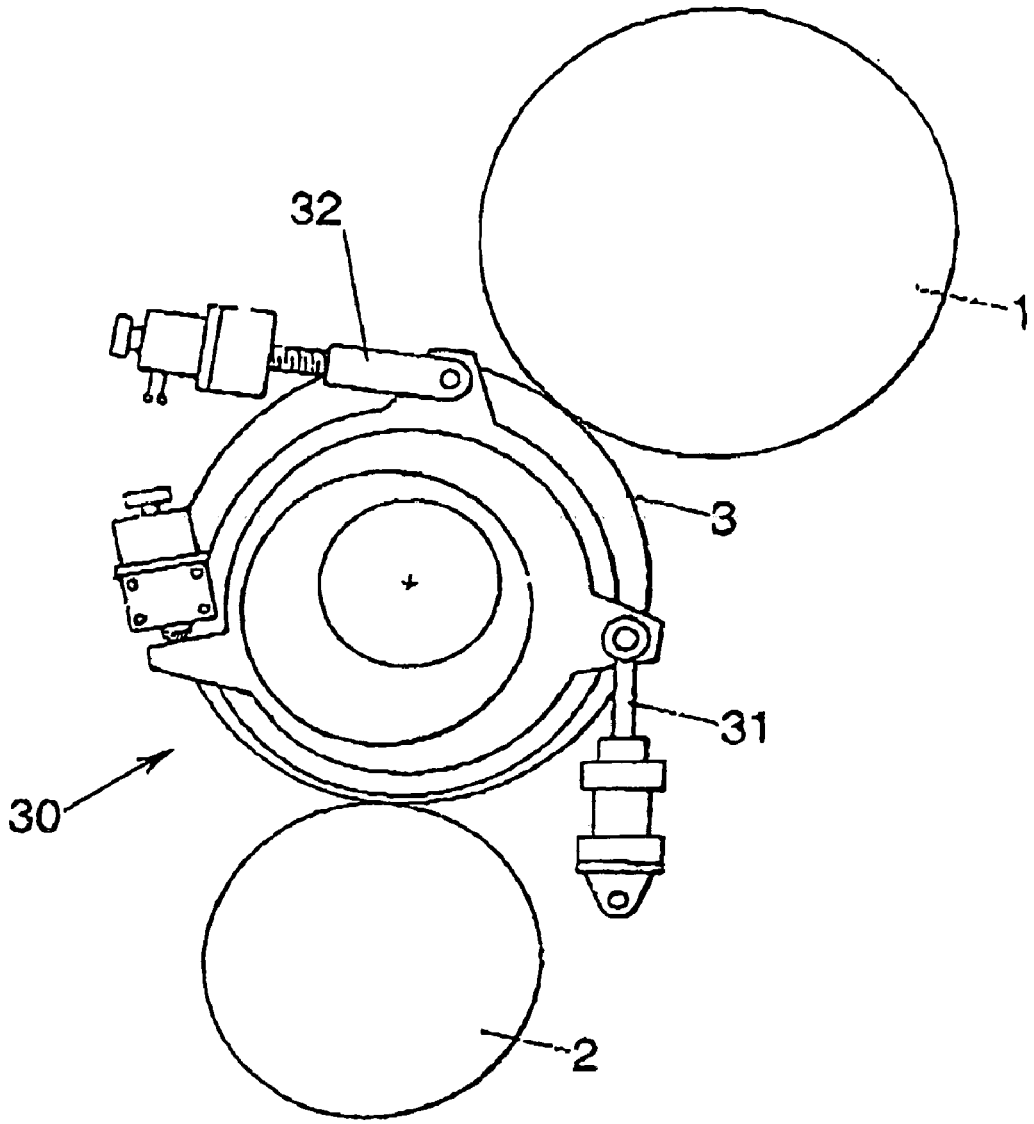
FIG. 4 is a schematic view of an apparatus in an alternative embodiment of the invention.

Furthermore, an arrangement with double eccentrics in accordance with FIG. 4 can also be provided for roll positioning, instead of the apparatus having linear guides. For this purpose, the bearing arrangement is accommodated in a double eccentric bush 30 of a know type, and adjustable-length levers 31, 32 are articulated respectively on the two eccentrics for the purpose of rotating the eccentrics. Levers of this type can be configured, for example, as threaded spindles having a driven spindle nut. A control/regulation such the controller 10 is provided for the regulated movement of the bearing 25 arrangement, in which device the eccentricities are predefined and which device actuates or regulates the drives firstly with regard to the position and secondly with regard to the pressing forces.

What is claimed is:

1. An apparatus for positioning a first roll in a printing unit of a rotary press with respect to at least a second roll adjacent the first roll, comprising:

a movable axle on which the first roll is mounted, the movable axel being mounted in at least one bearing arrangement movable with respect to a sidewall of the printing unit;

a first linear transport unit, a second linear transport unit on the first linear transport unit which forms a cross slide, said bearing arrangement of the first roll being coupled to the second linear transport unit such that the bearing arrangement is movable in a plane parallel to the sidewall of the printing unit, sensing means for generating signals for determining a position and a pressing force of the first roll against the second roll;

a controller for receiving the signals and controlling the position and pressing force of the first roll based against the second roll on the received signals and by means of combined travel and force regulation of the first roll, and and said controller having predefinable parameters for controlling positioning of the first roll.

2. An apparatus as in claim 1 including a third roll, and said controller being operable for controlling movement and position of the first roll to control pressing forces of the first roll against the second roll and a third roll independently of one another.

3. An apparatus as in claim 2, further including a first drive for driving the first linear transport unit and a second drive for driving the second linear transport unit, wherein values for the pressing forces of the first roll against the second and third rolls are set individually in the control device, and wherein the controller achieves the values of the pressing forces by activation of the first and second drives.

4. An apparatus as in claim 3, wherein the signals include signals indicating electrical current consumption of the first and second drives.

5. An apparatus as in claim 2, wherein the sensing means includes first and second position sensors integrated in first and second linear transport units for recording the position of the bearing arrangement.

6. An apparatus as in claim 1, further including a double eccentric bush coupled to the bearing arrangement of the first roll for positioning the first roll, the double eccentric bush including eccentrics rotatable with respect to one another and adjustable-length levers for rotating the eccentrics.

7. An apparatus as in claim 1, wherein the controller stores control data representing predefinable movement paths and positions for the bearing arrangement.

8. An apparatus as in claim 7, wherein the control data include data representing an arcuate movement path for moving the first roll away from a third roll while maintaining contact against the second roll.

9. An apparatus as in claim 8, wherein the control data further include data representing a predefinable position of the first roll away from both the second and third rolls.

10. An apparatus for positioning a first roll in a printing unit of a rotary press with respect to at least a second roll adjacent the first roll, comprising:

a movable axle on which the first roll is mounted, the movable axel being mounted in at least one bearing arrangement movable with respect to a sidewall of the printing unit;

a first linear transport unit, a second linear transport unit on the first linear transport unit to form a cross slide, said bearing arrangement of the first roll being coupled to the second linear transport unit such that the bearing arrangement is movable in x and y directions that are peipendicular to each other, sensing means for generating signals for determining a position and a pressing force of the first roll against the second roll;

a controller for receiving the signals and controlling the position and pressing force of the first roll against the second roll based on the received signals and by means of combined travel and force regulation of the first roll, and said controller having predefinable parameters for controlling positioning of the first roll.

* * * * *